United States Patent [19]

Cooper et al.

[11] Patent Number: 4,658,934

[45] Date of Patent: Apr. 21, 1987

[54] ELEVATING APPARATUS

[76] Inventors: Noel G. Cooper, 6 Kenna Street, West Chermside, Brisbane, Queensland, 4032; Roy A. Dillon, 3 Thelbo Court, Boondall, Brisbane, Queensland, 4034, both of Australia

[21] Appl. No.: 517,523

[22] PCT Filed: Nov. 22, 1982

[86] PCT No.: PCT/AU82/00194

§ 371 Date: Jul. 18, 1983

§ 102(e) Date: Jul. 18, 1983

[87] PCT Pub. No.: WO83/01938

PCT Pub. Date: Jun. 9, 1983

[30] Foreign Application Priority Data

Nov. 24, 1981 [AU] Australia ..... PF1677
Nov. 19, 1982 [NZ] New Zealand ..... 202505

[51] Int. Cl.[4] ..... B66B 1/00; B66B 5/02; B66B 13/16

[52] U.S. Cl. ..... 187/17; 187/28; 187/29 A; 187/61

[58] Field of Search ..... 187/17, 95, 29 A, 29 R, 187/6, 61, 28

[56] References Cited

U.S. PATENT DOCUMENTS

| | | | |
|---|---|---|---|
| 3,200,905 | 8/1965 | Holdridge | 187/61 X |
| 3,244,258 | 4/1966 | Neidert | 187/73 |
| 3,369,633 | 2/1968 | Martin | 187/29 A |
| 3,517,774 | 6/1970 | Meyer | 187/6 |
| 3,532,186 | 10/1970 | Swartzell | 187/29 |
| 3,591,028 | 7/1971 | McClung | 414/313 |
| 3,706,357 | 12/1972 | Simpson | 187/29 R |
| 3,842,943 | 10/1974 | Nakamura et al. | 187/17 X |
| 4,034,839 | 7/1977 | Lee | 194/1 N X |
| 4,051,923 | 10/1977 | Blanchette et al. | 187/25 |
| 4,234,070 | 11/1980 | Heiman | 194/1 N |
| 4,237,536 | 12/1980 | Enelow et al. | 364/465 |
| 4,249,641 | 2/1981 | Takenoshita et al. | 187/29 A |
| 4,262,777 | 4/1981 | Christopher | 187/17 |
| 4,412,600 | 11/1983 | Ito et al. | 187/17 |
| 4,427,094 | 1/1984 | Winkelblech | 187/25 |

FOREIGN PATENT DOCUMENTS

| | | |
|---|---|---|
| 268167 | 5/1963 | Australia . |
| 46482 | 1/1966 | Australia . |
| 0470742 | 2/1974 | Australia . |
| 15758 | 10/1882 | Canada . |
| 38641 | 4/1892 | Canada . |
| 1406230 | 3/1969 | Fed. Rep. of Germany . |
| 1901514 | 7/1969 | Fed. Rep. of Germany . |
| 2029367 | 12/1971 | Fed. Rep. of Germany . |
| 1486182 | 6/1967 | France . |
| 177761 | 7/1976 | New Zealand . |

*Primary Examiner*—Joseph J. Rolla
*Assistant Examiner*—Nils E. Pedersen
*Attorney, Agent, or Firm*—Jackson & Jones

[57] ABSTRACT

A lift or elevator for goods or passengers suitable for installation to existing low rise residential or commercial buildings. The lift comprises an upright hollow column (40) having a slot extending along the length of one face (47) thereof, a carriage (50) slidably mounted within the column on tracks (48), a cantilever beam assembly (54) supporting a lift car (55) attached by brackets (52, 53) to the carriage through the slot, a hydraulic ram (60) mounted within the column beneath the carriage and a cable (66) attached to a retaining member (67) at one end, and, via a pulley (63), to the carriage at the other end for elevation thereof. An electrical control circuit, an hydraulic control circuit as well as a method of installing the lift are also disclosed.

9 Claims, 16 Drawing Figures

FIG. 8
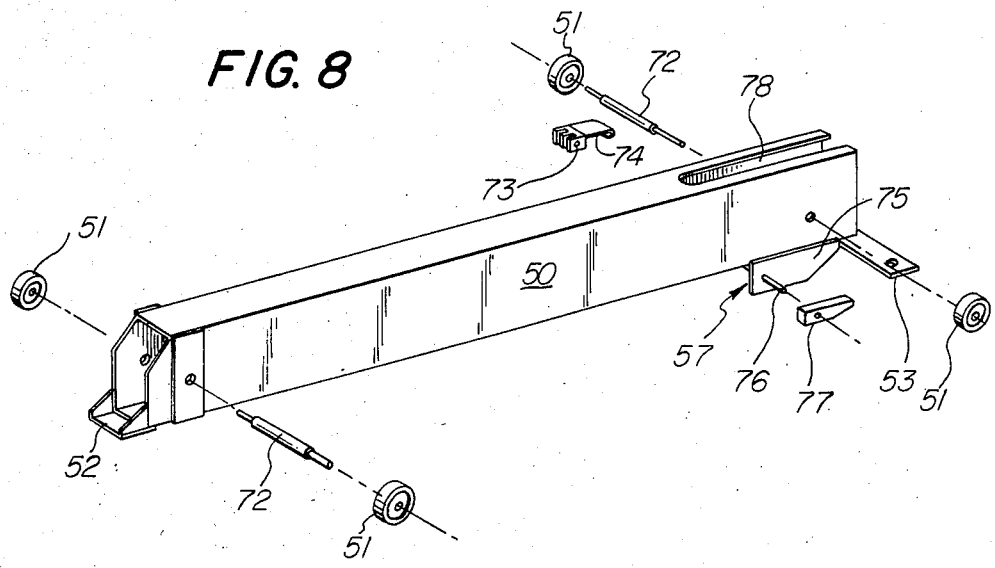
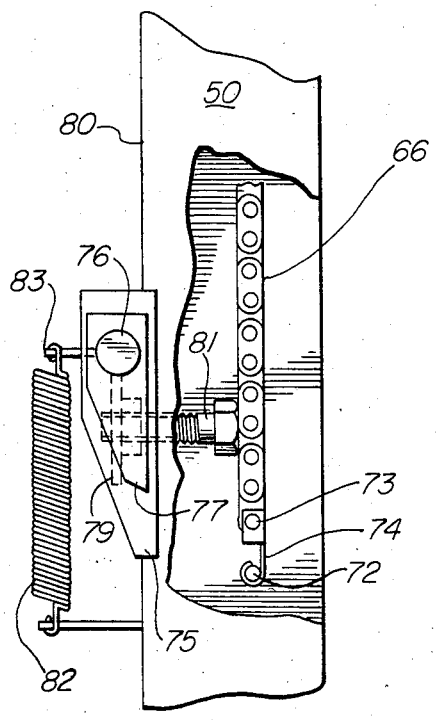
FIG. 9
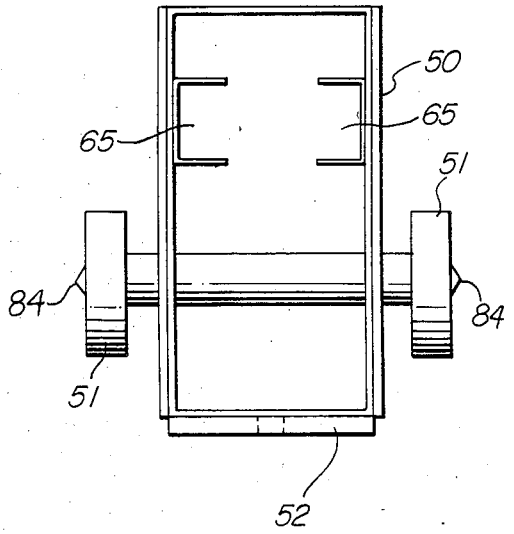
FIG. 10

ELEVATING APPARATUS

BACKGROUND OF THE INVENTION

1. Field of the Invention

This invention relates to an elevating device such as a goods or passenger lift or elevator which is particularly although not exclusively suitable for installation in low rise residential buildings.

2. Background Discussion

Conventional lifts or elevators for medium to high rise residential or office buildings generally comprise a car suspended by a block and tackle mechanism and controlled by an electric hoist. In medium rise buildings the car may be moved up and down by an extensible hydraulic lift mechanism situated below the car. In both cases, the lift well must be formed as an integral part of the building structure during construction. With the former type of lift, a winch room must be provided atop the lift well to house the hoist mechanism and with the latter a deep well must be provided to house the hydraulic hoist apparatus. Stringent safety regulations applied to such lifts or elevators impose severe design constraints on their construction, making them uneconomical in buildings of less than say, five or six floors. A further disadvantage of these types of lifts or elevators is that generally it is not possible to retrofit such apparatus to existing buildings due to structural limitations or prohibitive cost considerations.

In an endeavor to overcome the above problems and to provide a lift or elevator structure for low rise buildings of say, two to four floors, it has been proposed to provide a screw-driven lift or elevator. In such a structure, the car is mounted for sliding movement on a pair of tracks spaced at a width approximately that of the car. The tracks are generally U-shaped channel sections and they accommodate rollers mounted on each side of the car adjacent both the top and bottom of the rear wall of the car. The elevating mechanism comprises either a driven helical screw with a fixed nut attached to the car or vice versa.

Although these screw-driven lifts or elevators are generally satisfactory in operation they nevertheless suffer certain disadvantages. The main disadvantage is the cost of installation due to the problems of mounting the spaced parallel roller guide tracks, particularly when such an apparatus is being retrofitted to an existing building. For this type of lift, the tracks must extend to the full height of travel of the lift, i.e., at least to the ceiling of the first floor in a ground to first floor elevation. Another main disadvantage is the lack of flexibility in mounting of the apparatus. A continuous wall structure is needed behind such screw-driven lifts or elevators in order to mount the tracks thereto. In addition, considerable space must be provided between the support wall and the rear wall of the car to locate the helical screw drive mechanism. Space must also be provided beneath the floor of the car to accommodate the screw/nut drive mechanism when the car is fully lowered. Other disadvantages are that access to or from the car is not possible from the rear of the car due to the configuration of the tracks and further, space must be provided to enable the guide tracks to extend to the full height of travel of the car.

A significant disadvantage of prior art small elevators used in residential situations relates to their control mechanisms. Lifts of this type powered by mechanical and/or hydraulic means have an instantaneous stop and start control mechanism. Starting and stopping of the lift car is accompanied by a jerking motion and often an audible "clunk". The lack of smooth, silent operation normally associated with this type of lift in a large office building can engender a feeling of insecurity in a passenger, particularly a nervous person or an elderly or infirm person.

Prior art personnel elevators are described in Australian Pat. Nos. 408,046 and 446,606. Other hoisting mechanisms of various kinds embodying a columnar support similar in principle to the present invention are described in Australian Pat. Nos. 153,308, 153,364, 219,658 and Australian Patent Applications 1926/21, 14680/70 and 37523/78.

SUMMARY OF THE INVENTION

It is an aim of the present invention to overcome or alleviate the disadvantages of prior art lifts or elevators and to provide a simple device which enables greater flexibility of installation at a reduced cost.

According to one aspect of the invention there is provided a lift or elevator comprising:

- a substantially hollow column with an elongate aperture extending lengthwise thereof;
- a carriage assembly slidably mounted within said column;
- a cantilever beam assembly attached to said carriage and situated substantially outwardly of said aperture;
- an hydraulic cylinder means mounted within said column; and,
- means operatively connecting said hydraulic cylinder means with said carriage assembly.

Preferably said means operatively connecting said hydraulic cylinder means with said carriage assembly comprises a cable and pulley assembly incorporating a mechanical advantage.

Preferably said cantilever beam assembly includes a platform means.

Preferably said platform means is associated with a frame means to define a personnel car.

Preferably said column comprises one or more channel members to slidably locate said carriage assembly.

Preferably said carriage assembly includes roller means slidably associated with said channel members.

Perferably said lift or elevator includes control means to selectively raise or lower said carriage assembly.

Preferably said control means includes solenoid operated valve means to selectively control a supply of operating fluid to said hydraulic cylinder.

According to another aspect of the invention, there is provided a method of installation of a lift or elevator according to the invention comprising: mounting said column adjacent its upper and lower ends to a building structure.

It is to be understood that the expression "cable" used herein includes a chain or like flexible connection means.

BRIEF DESCRIPTION OF THE DRAWINGS

Preferred embodiments of the invention will now be described with reference to the accompanying drawings in which:

FIG. 8 shows the carriage member of FIG. 6.

FIG. 9 is an enlarged partial view of FIG. 8

FIG. 10 is a cross-sectional view of the carriage member of FIG. 8.

DESCRIPTION OF THE PREFERRED EMBODIMENT

Figure 1:
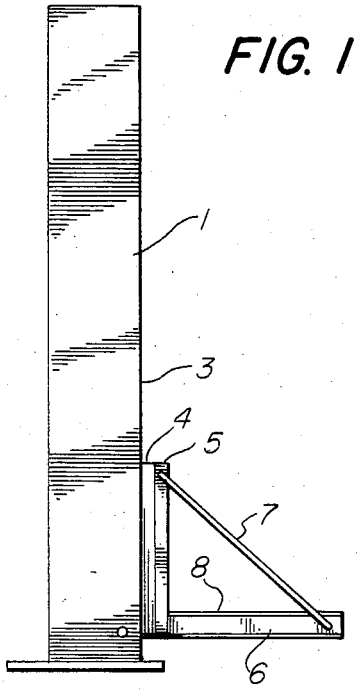
FIG. 1 illustrates a side elevation of one embodiment of the apparatus.

In FIG. 1, the apparatus comprises an upright substantially hollow column 1, preferably rectangular in cross-section. The column 1 is attached to a base plate 2 for mounting on a ground or other horizontal surface. Extending partially from an elongate aperture (not shown) in the front surface 3 of the column is a carriage 4 slidably mounted within the column for movement in an upright direction. Attached to the carriage 4 is a cantilever beam assembly comprising a rear frame 5, a base frame comprising outwardly extending arms 6 and braces 7. A platform 8 is supported by arms 6.

Figure 2:
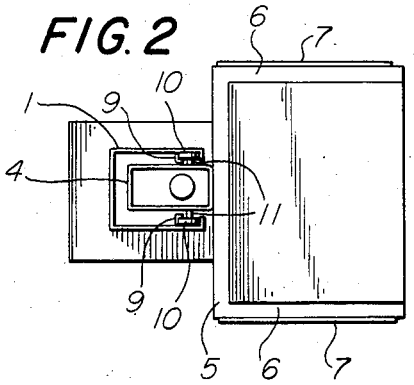
FIG. 2 illustrates a plan view of the apparatus of FIG. 1.

In FIG. 2 the column 1 comprises a generally U-shaped channel which may be a rolled steel section or a cast steel section. Mounted adjacent the front aperture of the column 1 are generally C-shaped steel channel members 9 which extend over substantially the entire length of the column. Slidably mounted within channel members 9 are slide members 10 which preferably comprise rollers bearings. The roller bearings 10 are suitably mounted for rotation about bosses 11 extending from either side of carriage 4.

Carriage 4 suitably comprises a hollow box-like section to accommodate an hydraulic ram 13 located within the column 1. Attached to the carriage 4 is the cantilever beam assembly which may comprise a framework of angle section or tube section.

The beam assembly and platform 8 are suitably of steel or light gauge stainless steel but are preferably of aluminum to reduce weight.

Figure 3:
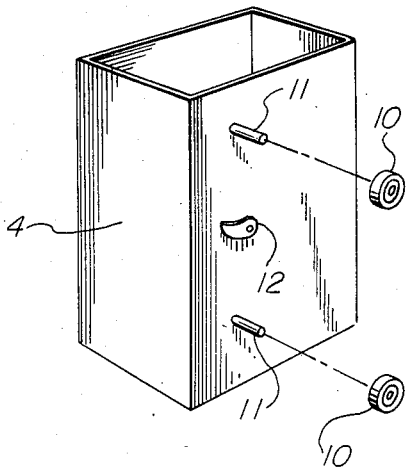
FIG. 3 illustrates an exploded view of a portion of the carriage assembly of FIG. 1.

In FIG. 3 the carriage 4 comprises a rectangular hollow box section member with aligned bosses 11 depending from each side of the carriage. Roller bearings 10 are journalled for rotation on the bosses. A cam locking mechanism 12 of known type is pivotably mounted on one or preferably both sides of the carriage in substantial vertical alignment with bosses 11. The cams are adapted to be normally biased toward a retracted position free from engagement with channels 9. The biasing means may comprise any suitable mechanism such that in the event of breakage of an elevating cable, uncontrolled downward movement of the carriage is prevented by locking engagement of the cams 12 with channels 9.

Suitably, the biasing means is connected to the elevating cable such that the unloaded weight of the carriage and/or beam assembly on the cable is sufficient to bias the cams toward a normally retracted position.

Figure 4:
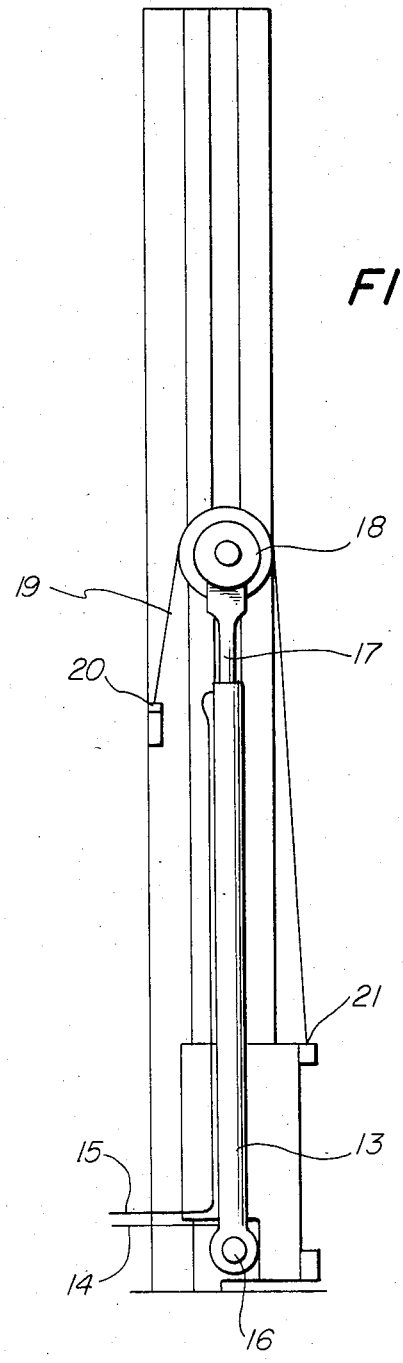
FIG. 4 illustrates a sectional side view of FIG. 1.

In FIG. 4, the elevating means comprises a duplex hydraulic cylinder 13 with inlet and return lines 14 and 15 respectively. The lower end of cylinder 13 is pivotally mounted within column 1 about pivotal attachment point 16 for ease of installation and removal. At the remote end of cylinder rod 17 is rotatably mounted a pulley (or sprocket) 18 over which passes a cable (or chain or like flexible connecting member) 19 which is fixed at one end 20 to column 1 and at its other end 21 to the carriage 4 of the beam assembly. By selective operation of an hydraulic pump means (not shown) connected to the inlet and return lines 14 and 15 respectively, it can be seen that extension of the piston rod 17 causes elevation of the carriage 4 with a mechanical advantage by virtue of the pulley and cable.

Figure 5:
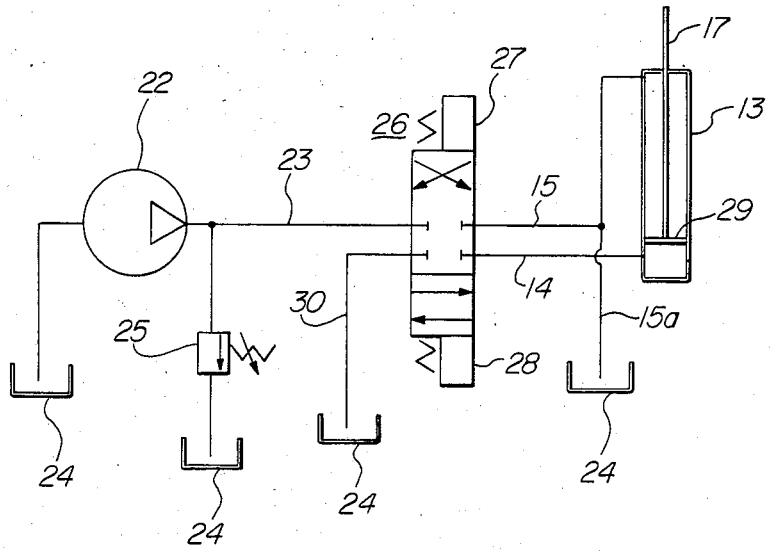
FIG. 5 illustrates schematically an hydraulic control circuit for the apparatus shown in FIG. 1.

FIG. 5 illustrates schematically a suitable hydraulic circuit. Electrically operated pump 22 pressurizes feed line 23 with an hydraulic fluid drawn from reservoir 24. A pressure control valve 25 in the feed line 23 permits pump 22 to operate either continuously or intermittently as required. A solenoid valve system 26 connected to feed line 23 comprises a duplex switching valve to control the operation of hydraulic cylinder 13. The valve comprises electrically operated solenoids 27 and 28 which permit selective extension or retraction of cylinder rod 17. With the pump 22 operating and both valves in the closed position, the hydraulic fluid is simply recycled to the reservoir 24 by control valve 25. Upon actuation of valve 27, hydraulic fluid is caused to enter inlet line 14, thus effecting extension of cylinder rod 17. Simultaneously hydraulic fluid contained on the upper side of piston 29 is caused to flow via return lines 15 and 15*a* to reservoir 24 under the influence of pressure on the inlet side of the piston. Extension of cylinder rod 17 can be stopped selectively at any point during its extension cycle by deactivation of solenoid 27. Downward movement of the cylinder rod 17 even under load is then prevented as the hydraulic fluid on the inlet side of piston 29 is prevented from passing through valve 26. Selective lowering of cylinder rod 17 is effected by actuation of solenoid valve 28 which permits hydraulic fluid to pass under pressure from the supported load via inlet line 14 through valve 26 and return line 30 to the reservoir 24. Rate of descent of cylinder rod 17 is controlled by provision of appropriately sized restriction nozzles in line 30 to suit the particular load requirements.

It can be seen therefore that in the event of pump failure or a burst in either of lines 23 or 14, safe lowering of the lifts or elevation may be controlled by valve 26 and/or the restriction nozzle in line 30. In the event of a total electrical failure, mechanical actuating means may be provided to override either or both of solenoid valves 27 and 28 to safely lower the lift or elevator from a raised position.

The cantilever beam assembly includes a framework to define a personnel car. Such a framework may include side walls on any or all of the sides of the platform and, if required, a roof may be provided. Access doors may be provided in one or more of the side walls. For most installations, a safety cage would be provided to fully enclose the lift or elevator structure. Access doors would be provided at the fully lowered and/or each elevated station. Lockable latches in the access doors of the safety cage and the personnel car would provide both security and safety in operation. Preferably the access doors would include electrical isolating switches such as microswitches to prevent accidental raising or lowering of the lift when any one of such doors was in an open state. Actuation of the lift or elevator to raise or lower the personnel car would preferably be also key controlled from the ground level to further enhance safety and security of operation. Suitably limited control switches are provided at each access station to prevent overrun of the personnel car.

In the embodiment hereinbefore described, one advantage is that the support column need only extend for a short distance above the elevated floor level of the car. This distance corresponds to the height of the carriage. Accordingly, where such an apparatus is installed in a residential situation, there is no requirement for the column to extend to the roof of the second level for support. Support at the upper floor level is sufficient.

A preferred embodiment of the invention will now be described with reference to FIGS. 6–16.

This embodiment is a further development of the apparatus previously described.

Figure 6:
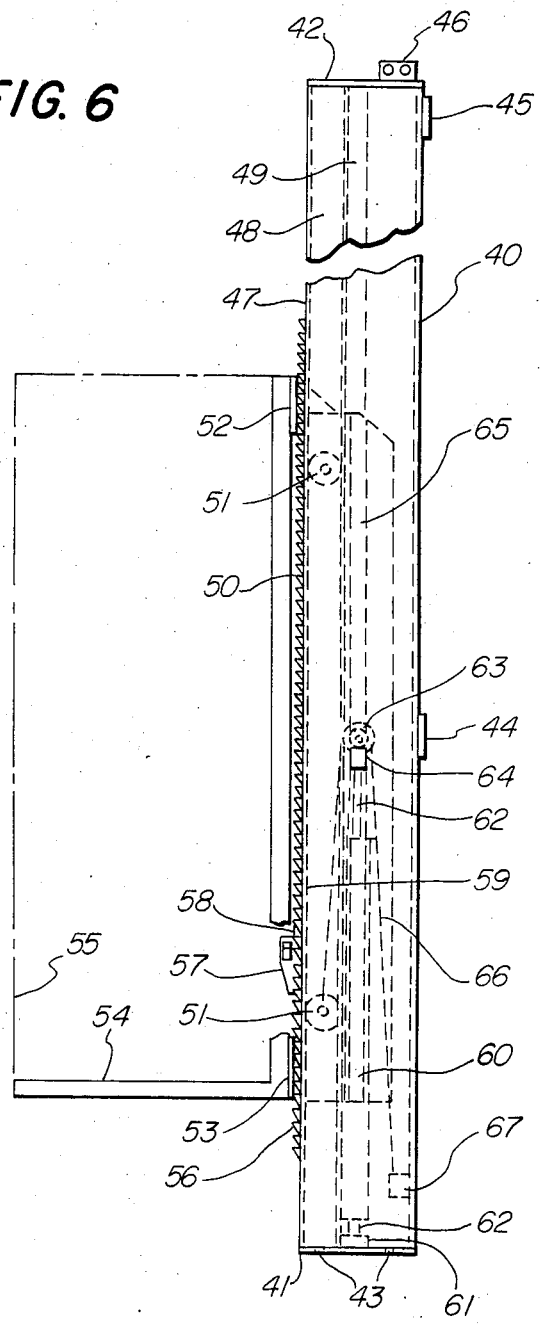
FIG. 6 is an alternative embodiment of the apparatus.

In FIG. 6 the apparatus comprises a column 40 with a base plate 41 and a top cap 42. The base plate 41 includes apertures 43 for mounting the base of the column to a support surface by bolts or the like. The column 40 may include a bracket 44 intermediate its length for mounting to a wall surface or to a floor frame member at a first floor level. Alternatively or additionally, mounting brackets 45 and 46 may be attached adjacent the upper end of the column if a more rigid mounting is required. In a situation where the column is mounted on an exterior side wall of a building, brackets 44, 45, 46 may be attached to the side of the column. Further, where the column is effectively free standing, braces may be attached between brackets 44, 45 and/or 46 and an adjacent supporting surface. In the latter case, the base plate 40 may be suitably enlarged or reinforced as required.

Column 40 comprises a hollow rectangular member with an elongate slot extending longitudinally of its front face 47. Mounted within the column 40 are opposed C-shaped channels 48 adjacent the front face 47. Reinforcing members 49 are mounted within the column 40 to reinforce channels 48.

Slidably mounted within column 40 is a carriage member 50. Carriage member 50 is a substantially rectangular hollow member having a width slightly less than the longitudinal aperture in front face 47 of column 40. The carriage member 50 is located within column 40 by opposed pairs of rollers 51 slidably located within channels 48. Rollers 51 comprise roller bearings mounted on stub axles attached to carriage member 50. The roller bearings are fitted with resilient tires of polyurethane to reduce noise and vibration. Resilient buffers are fitted to the hubs of the rollers to reduce noise and vibration from any sideways movement of the carriage 50. A portion of carriage member 50 protrudes from the longitudinal aperture in front face 47 and this includes upper and lower mounting brackets 52 and 53, respectively. A car frame member 54 comprising a wall and floor frame is attached to brackets 52 and 53 by any suitable means such as by bolting. The dotted outline at 55 represents schematically the lift car.

A sawtoothed safety rack 56 is provided on one or both of front face portions 47 adjacent the longitudinal aperture. The rack 56 extends substantially over the distance of travel of the lower part of the carriage member 50. A toothed engagement member shown schematically at 57 is adapted for selective engagement with rack 56 to prevent downward travel. This mechanism is described in detail later.

Rack 56 is preferably welded to column 40 but it includes a removable portion 58 which is situated over an aperture 59 which extends through front face portions 47 and opposing channels 48 to facilitate assembly of the apparatus and/or in situ removal of the carriage assembly 50 from column 40 for repairs and maintenance.

Also mounted within column 40 is an hydraulic cylinder 60. Cylinder 60 is located at its lower end by a socket 61 and spigot 62 on the base 41 and cylinder 60, respectively. The upper end of cylinder shaft 62 is provided with a sheave or pulley assembly 63. Rollers 64 are provided on either side of assembly 63 to locate the upper end of cylinder 60. Rollers 64 are slidably located in channels 65 on the inner walls of carriage assembly 50. Rollers 64 include resilient tires and end buffers in a similar manner to rollers 51.

A cable or preferably a chain 66 is attached at one end to a retaining member 67 attached to the column 40. The chain 66 passes over pulley assembly 63 and is attached at its other end to the carriage member 50 adjacent its lower end on the axle assembly of lower rollers 51.

With the arrangement illustrated in FIG. 6 it can be seen that an elevation height:cylinder length ratio of almost 3:1 can be achieved.

Figure 7:
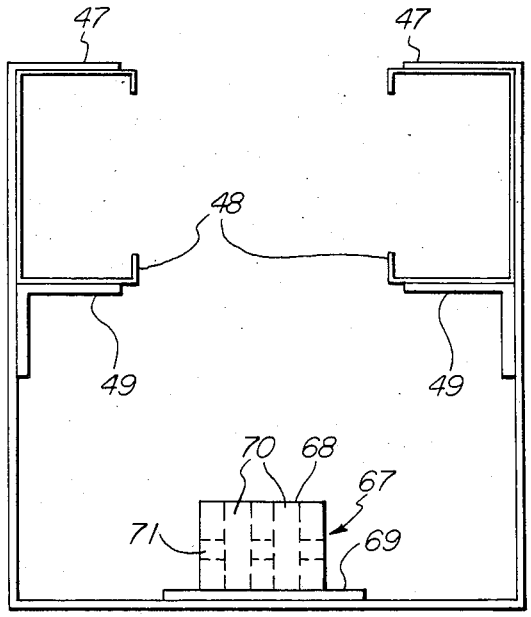
FIG. 7 is a cross-section of the column of FIG. 6.

FIG. 7 is a cross-section of column 40 showing detail of C-shaped channel members 48 and reinforcing members 49. These reinforcing members comprise angle section steel or the like to brace the rear portion of the channels 48 at least in the region of travel of the lower rollers 51. By bracing the channels in this region it is possible to use lighter gauge channel section than would otherwise be required to counter the inwardly directed force on lower wheels 51 from the lift car. The outwardly directed force on the upper rollers 51 is supported within channels 48 by column front face portions 47.

Chain retaining member 67 comprises a block 68 mounted on a mounting bracket 69 for attachment to the rear wall of column 40 by welding or bolting. Block 68 includes spaced slots 70 to accommodate chain link members and an aperture 71 to receive a retaining pin or bolt.

FIG. 8 is an exploded view of carriage member 50 showing the hollow boxlike body of member 50 and upper and lower brackets 52 and 53, respectively. Rollers 51 are mounted on axles passing through member 50. A chain retaining member 73 similar to member 67 is attached to axle 72 by a suitable bracket 74. Toothed engagement member 57 is shown partially exploded with a mounting flange 75 and a pivotable member 76 extending therethrough to a similar flange (not shown) on the other side of member 50. A tooth member 77 is attachable to pivotable member 76 for cooperative pivotable motion. A slotted aperture 78 is provided at the rear of member 50 to facilitate access to the hydraulic cylinder conduit connections when the apparatus is assembled.

FIG. 9 is an enlarged partial view of the lower end of member 50 showing the operating characteristics of retaining member 53. Pivotable member 76 comprises a shaft to which is attached a plate 79 extending generally in the plane of the front wall 80 of carriage 50. A screw-threaded bolt 81 is adjustably engaged in a screw-threaded aperture in plate 79 with the upper shank of the bolt 81 extending through an aperture (not shown) in front wall 80 of carriage member 50. The head of bolt 81 is urged against chain 66 by one or more springs 82 connected at one end to face 80 and at the other end to a lever member 83. By adjustment of bolt 81, tooth 77 can be made, under normal operating conditions to be close to rack 56 on the front face 47 of the column but clear enough to avoid accidental engagement. In the event of chain breakage or bursting of the hydraulic cylinder, the tension on chain 66 is relieved and thus there is no longer a resistance to the biassing force of springs 82. Tooth 77 pivots inwardly and immediately and self-lockingly engages toothed rack 56, thus restraining the lift car against falling.

FIG. 10 illustrates a cross-sectional view of carriage member 50 viewed towards the normally upper end. Resilient end buffers 84 are shown fitted to the hubs of rollers 51 to prevent noise and vibration due to side play in channels 48.

Figure 11:
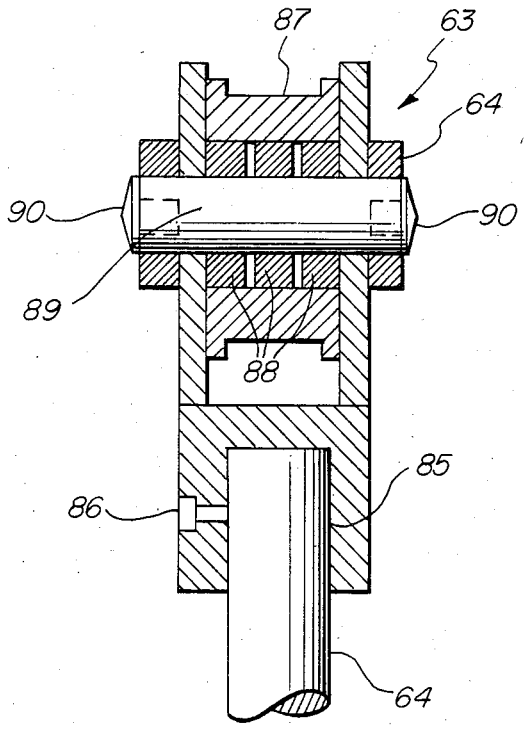
FIG. 11 illustrates a safety mechanism.

FIG. 11 illustrates in detail the cross-section of roller assembly of FIG. 6. The lower part of the assembly comprises a socket 85 to receive the end of cylinder shaft 64 which may be retained by a set screw 86. Grooved roller sheave or pulley 87 is rotatably journalled on roller bearings 88 supported on axle 89. Additional roller bearings 64 (preferably resiliently tired) are situated on the outer ends of axle 89 for slidable movement within channels 65 of carriage member 50. Resilient end buffers are inserted into the hubs of rollers 64 to reduce noise and vibration from end play within the channels.

Figure 12:
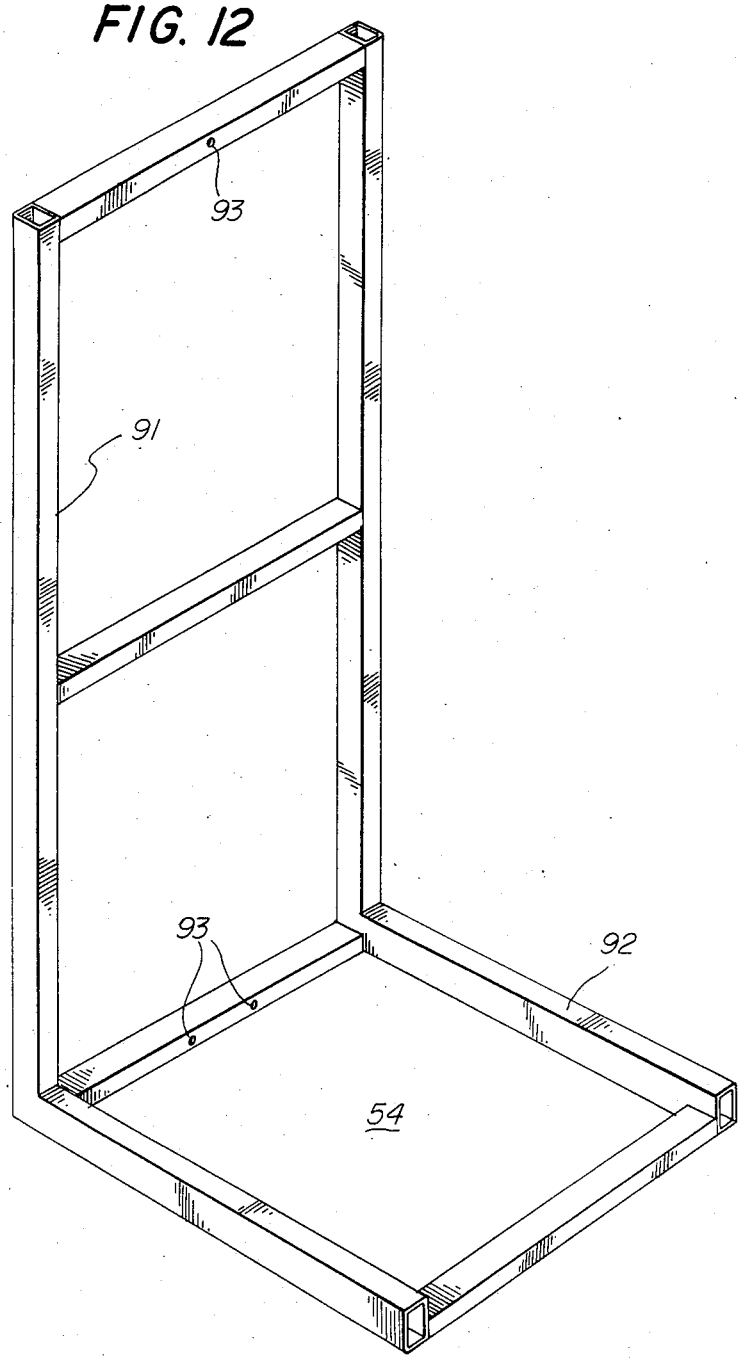
FIG. 12 illustrates a lift car frame.

FIG. 12 illustrates a typical car frame 54 comprising a wall frame 91 and a floor frame 92. Wall frame 91 has apertures 93 to enable attachment to upper and lower mounting brackets 52 and 53, respectively, on carriage member 50. It will be clear to a skilled addressee that a lift car body of any desired configuration may be constructed on frame 54. Preferably the remainder of the car is constructed of lightweight materials such as aluminium, plastics, etc., with suitable doors, gates or the like for access.

Figure 13:
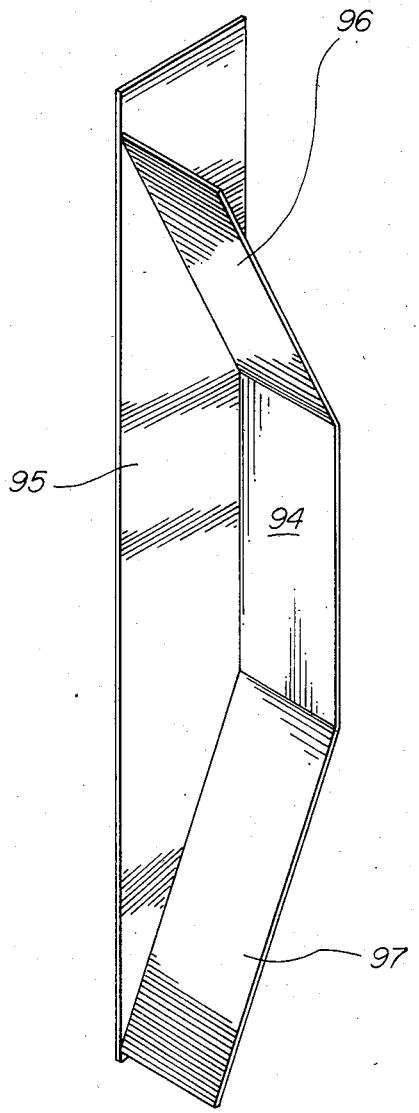
FIG. 13 illustrates a limit switch activator.

FIG. 13 shows a typical limit switch activator member 94. The activator comprises a mounting flange 95 and upper and lower ramped surfaces 96, 97, respectively, to engage respective upper and lower limit switches to control motion of the lift car. The operation of these limit switches is described in detail later. Flange 94 is adapted for mounting on the lift car frame by bolting or any other suitable means.

Figure 14:
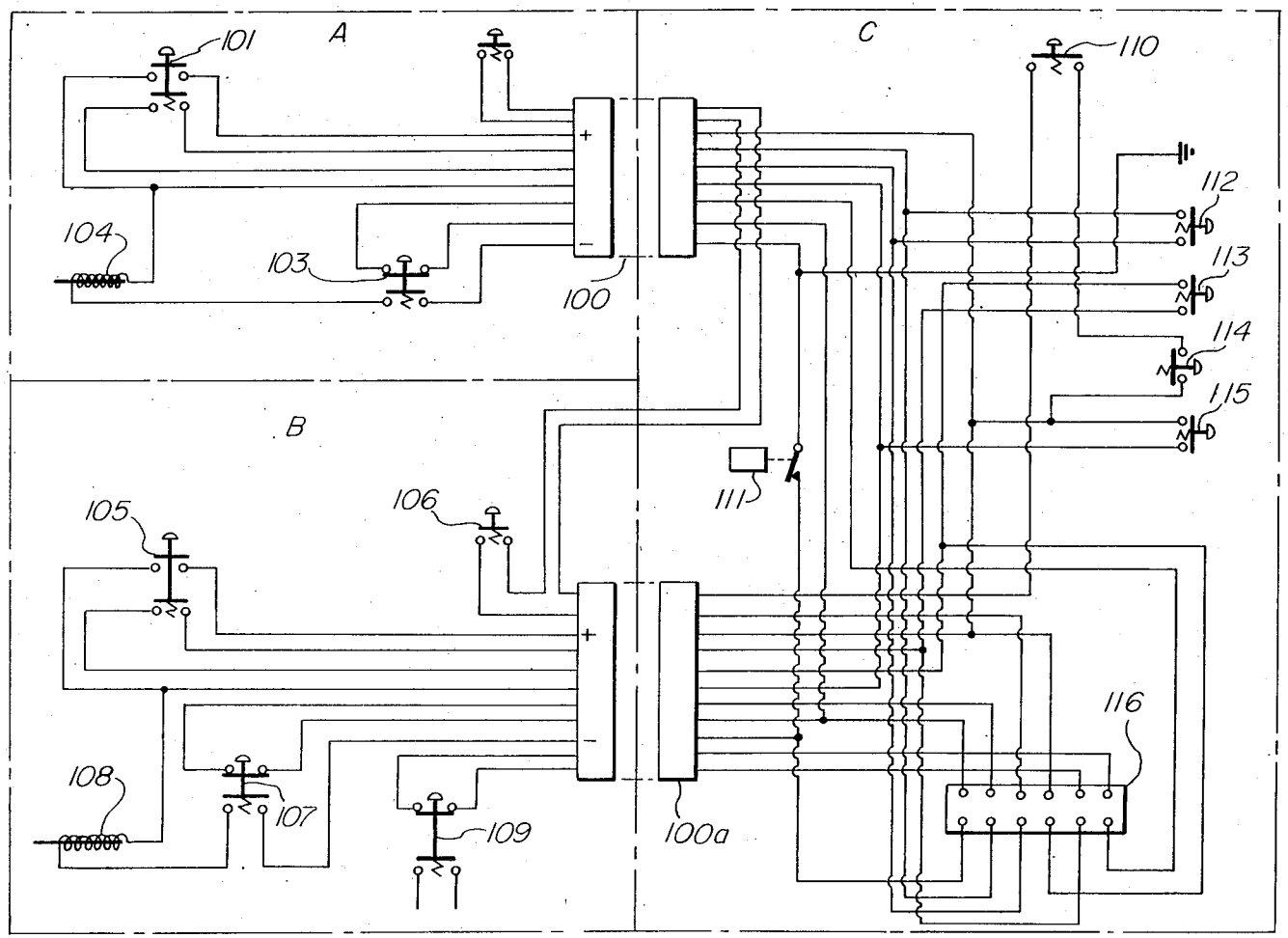
FIG. 14 illustrates a portion of an electrical control circuit.

FIG. 14 illustrates a typical electrical control circuit for the lift according to the invention. The circuit is divided into three main portions separated by multipin plug and socket assemblies 100, 100*a*. Circuit A represents the control circuit located on the elevated floor. Circuit B represents the control circuit located at the ground floor and Circuit C represents the control circuit located in the mobile lift car.

All control circuits are preferably independent of the main voltage operating circuits for pump motor, lighting, etc. The independently powered control circuits thus provide a safety feature to avoid entrapment in the event of a main power failure. In the present invention the control circuits are powered by a 12-volt car battery on the like, the battery being connected to main voltage via a battery charger to maintain battery charge.

Circuit A comprises a car call switch 101 to call the car from a lower floor. Switch 101 is connected in circuit to an isolating switch 102 attached to a car access gate on the upper floor level. Thus if the upper access gate is open call, switch 101 will be inoperative. Call switch 101 is also connected in circuit to a similar isolating switch on the lower access gate and also to an isolating switch on the lift car door. Thus if any one of the upper or lower gates of the lift car door is open, the car operating and control circuits are isolated. Circuit A also includes an upper limit switch 103 to isolate the operating circuit once the car has reached a desired elevated height. A solenoid operated lock 104 is provided on the upper access gate to prevent the gate being opened when the car is moving or is not at the elevated position to trip limit switch 103 to de-energize lock 104.

Circuit B is substantially identical to Circuit A in construction and function. The circuit includes a car call switch 105, a lower access gate isolating switch 106, a lower limit switch 107 and a solenoid actuated access gate lock 108. Circuit B also includes a line lock limit switch 109 which is connected to a solenoid operated line lock valve in the hydraulic circuit. The purpose of the line lock valve will be described later.

Circuits A and B are connected via plug and socket assemblies 100, 100*a* to the lift car control Circuit C situated within the car itself. Circuit C includes an isolating switch 110 connected in series with upper and lower access gates isolating switches 102 and 106 respectively to prevent car operation when any of the gates or the lift door is open. The circuit also includes a pressure-actuated switch 111 connected into the hydraulic circuit connected to the hydraulic cylinder. This switch is selected or is adjustable to sense an overload condition which may exceed safe operating conditions for the lift car.

Circuit C includes a switch panel with a plurality of control switches. Switches 112 and 113 are "up" and "down" control switches, respectively, and switch 114 is a "stop" switch. Switch 115 operates to energize either the upper or lower solenoid switches 104 or 105, respectively, when the earth circuit (12) is completed by operation of the corresponding limit switch 103 or 109. Plug or socket member 116 is provided for connection to the mains voltage operating circuit and a 12-volt safety override circuit.

Figure 15:
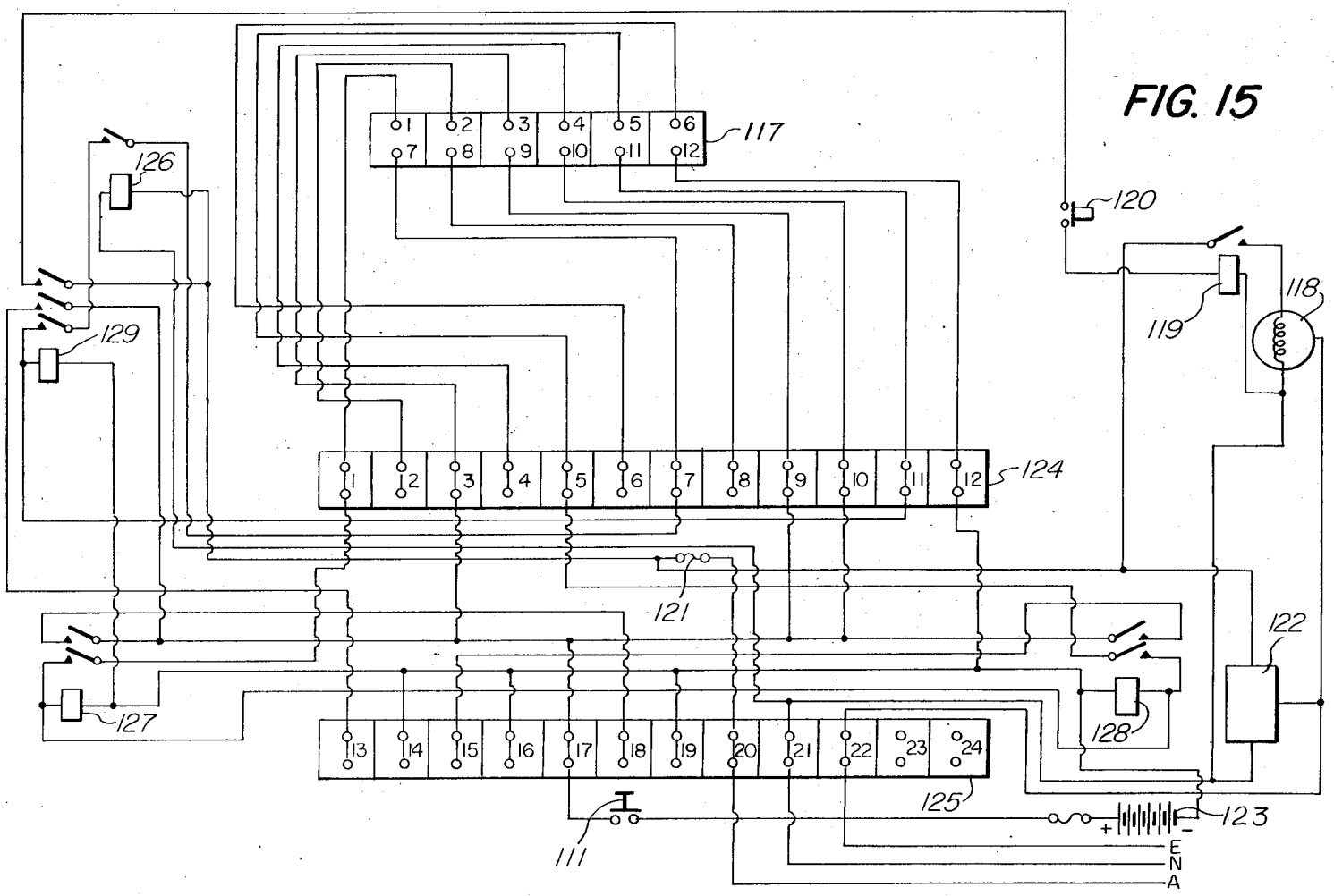
FIG. 15 illustrates the remaining portion of the control circuit.

FIG. 15 illustrates the main voltage control circuit in relation to the 12-volt safety circuit. Plug or socket member 117 is provided for connection to the corresponding member 116 shown in FIG. 14.

Main voltage is connected to hydraulic pump motor 118 which is controlled by switching relay 119, in turn controlled by a time switch 120. The purpose of timer switch 120 will be described later.

The main voltage power supply is connected via a fuse 121 to a battery charger 122 which is adapted for connection to a battery 123. For the sake of clarity terminal blocks 124 and 125 are numbered to show the control connections.

A normally open relay 126 is retained in a closed position by main voltage power to make the circuit with the pump motor 118. In the event of main power failure relay 126 breaks the operating circuit, leaving the 12-volt circuit intact to operate the line lock valve via line lock valve relay 127, as well as a hydraulic descent valve via valve relay 128. In this manner, the lift car, which might otherwise be restrained at an elevated position in a power failure, can be selectively lowered to a ground level. Once the car is lowered and the lower limit switch is activated, normal access controls such as the access gate solenoid lock can be activated. Selective lowering of the car under the above circumstances can be achieved by activating the "down button" which actuates line lock valve relay 127 and valve relay 128 to enable descent of the car at a controlled rate.

Once the main voltage power supply is restored, relay 126 closes to enable selective operation of the main voltage operating circuit via 12-volt control relay 129. Relay 129 is energized when the "up" switch 112 of FIG. 14 is actuated, thus closing the operating circuit to operate hydraulic pump motor 118.

In an alternative arrangement to FIG. 14, pressure-sensitive overload switch 111 may be connected on the positive input side of the 12 volt control circuit to isolate the entire control circuit.

Figure 16:
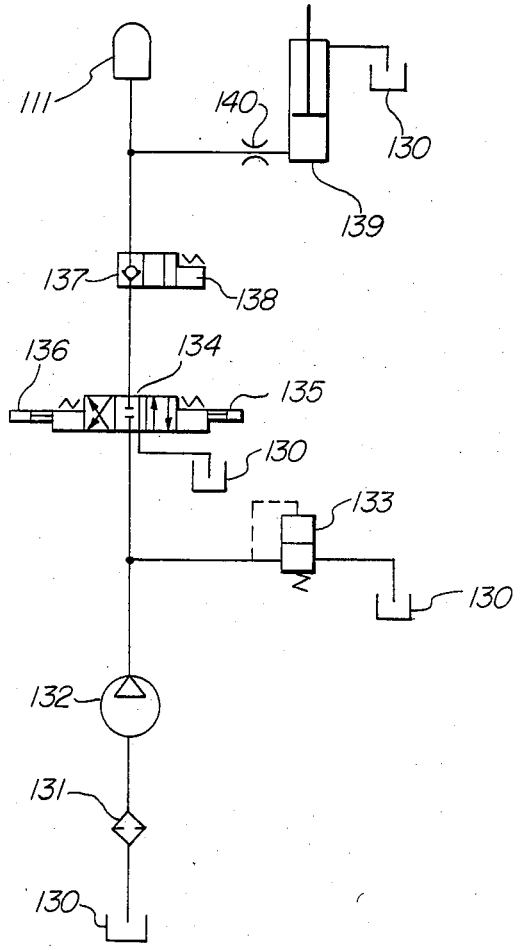
FIG. 16 illustrates an hydraulic circuit.

FIG. 16 illustrates schematically the hydraulic circuit according to the invention.

The circuit comprises a reservoir 130 connected via an hydraulic oil filter 131 to an hydraulic pump 132. The effective line operating pressure of pump 132 is controlled by adjustable relief valve 133 which has an overflow to reservoir 130.

The operating fluid from pump 132 is connected to control valve 134. Control valve 134 is a solenoid operated valve with a first solenoid 135 to open an ascent circuit and a second solenoid 136 to open a descent circuit.

Control valve 134 is connected to a line lock valve 137 which is effectively a nonreturn valve which may be selectively operated by a solenoid 138 to enable controlled return of hydraulic fluid under pressure.

The output side of the line lock valve is connected to hydraulic cylinder 139 and the return fluid passes via valve 134 to reservoir 130.

A pressure-actuated isolation switch 111 as illustrated in FIGS. 14 and 15 is connected in the hydraulic control line connected to cylinder 139. Between cylinder 139 and link lock valve 137 is a line restrictor 140.

The operation of the hydraulic circuit will now be described. With the lift car at its lowermost position and all electrical safety isolating switches actuated, the car is in a "ready" state. Upon pushing the "up" switch 112 of FIG. 14, hydraulic pump 132 is energized. Simultaneously solenoid 135 is energized to open control valve 134 to enable the hydraulic fluid to pass via line lock valve 137 to hydraulic cylinder 139. Line lock valve 137 is a one-way valve with a solenoid override control and thus needs no energization while the fluid flows towards the hydraulic cylinder.

Control valve 134 is chosen to have a very smooth operating action whereby the lift car initially commences ascent very slowly to avoid jerking as would otherwise happen with a conventional ON-OFF type valve.

When the lift car approaches the desired elevated height, the upper limit switch 103 (FIG. 14) is actuated to close valve 134 and to isolate the hydraulic pump motor. As previously stated, valve 134 is chosen to have a smooth opening and closing mechanism to avoid jerking on either starting or stopping of the car. To avoid a stopping jerk due to the sudden stop of the hydraulic motor, a time switch 120 (FIG. 14) is provided to run the hydraulic motor for several seconds after valve 134 is energized to close. Any excess pressure in the hydraulic circuit is relieved by the relief valve 133 which returns bypass fluid back to reservoir 130.

It can be seen thus that movement of the car on the elevating cycle is smooth and jerk free.

In the elevated position, the car is secured against descent by line lock valve 137, thereby avoiding the necessity to maintain a positive fluid pressure in the hydraulic circuit by pump 132 or to rely simply on valve 134.

To effect descent, the down switch is actuated to energize solenoid 138 of line lock valve 137. Simultaneously control valve 134 is actuated by solenoid 136 to permit a controlled descent, the hydraulic fluid in the circuit being redirected to reservoir 130.

The rate of descent of the lift car is controlled by a restrictor 140 suitably located at the inlet/outlet of hydraulic cylinder 139. In this manner, safe descent may be achieved even if there is a failure in any other part of the hydraulic circuit.

As the car approaches its descended or lower rest position, control valve 134 is actuated by lower limit switch 107 (FIG. 14) to bring the car to a smooth stop. Solenoid 138 of line lock valve 137 is then also de-energized to securely support the lift car.

It will be apparent to a skilled addressee that many modifications or variations may be made to the invention without departing from the spirit and scope thereof. For example a multistage hydraulic ram may be employed as an alternative to the hydraulic cylinder/-cable and pulley assembly.

The lift or elevator according to the invention is applicable to residential and commercial buildings for carriage of both people and goods. In designing a new structure such as a block of home units or the like with from, say, two to four floors, provision may be made for an internally-situated lift well with access to each floor. Installation of the apparatus is simply accomplished by attaching the column adjacent its upper and lower ends respectively to say a wall and a floor. The hydraulic pump/reservoir system is compact and suitably comprises a single-phase fractional horsepower motor which is simple and inexpensive to connect electrically.

A particular advantage of the present invention is the ease with which it may be retrofitted to existing buildings.

The apparatus may be installed in, say, a two-story dwelling by forming an appropriately sized aperture in the floor separating the two levels. The column is then attached to the lower floor at its base and to the upper floor adjacent its upper end. The cantilevered support for the carriage permits only limited intrusion into the upper level space of the upper portion of the column.

Alternatively, the apparatus may be fitted to the outside of a building structure by attaching the column directly to an outside wall or spaced from the wall and supported at its upper end by a bracket extending from the wall. Access to the upper floor may then be made to a balcony or via an aperture formed in the wall.

It can be seen that the present invention offers a lift or elevator which is simple and robust in construction, which provides ease of maintenance and above all which permits relatively inexpensive construction and installation to a wide variety of structures. The invention offers obvious advantages to aged or infirm persons residing in multistory dwellings.

We claim:

1. An hydraulic elevator system comprising:

a substantially hollow column with an elongate aperture extending lengthwise thereof;

a base member for fixably supporting said column above and extending away from a ground or floor level support surface;

means for securely attaching said supported column to a building support or wall;

a carriage assembly slidably mounted on resiliently-rotatable roller bearings within said column;

a multipassenger elevator car cantilevered from said slidably-movable carriage assembly;

an hydraulic ram assembly for elevating said carriage assembly, said hydraulic ram assembly being located within said substantially hollow column;

an hydraulic fluid reservoir and an electrically-powered hydraulic pump for selectively operating, in response to passenger control, said hydraulic ram to elevate said elevator car, said hydraulic pump being operable on a main voltage power supply, and a passenger-operable low-voltage control circuit for controlling ascent and descent of said elevator car from within said car and from external call stations, said low-voltage control circuit having a backup low-voltage power supply and safety means responsive to an emergency failure of said main voltage supply, for activating said low-voltage control circuit by said backup power supply to selectively control descent of said elevator car in response to passenger operation from within said car and from external call stations.

2. An hydraulic elevator system as claimed in claim 1 wherein said low-voltage control circuit is operably connected to a solenoid-actuated line-lock valve operable as a nonreturn valve, said line-lock valve solenoid being energizable by a low-voltage power supply to open said line-lock valve to enable controlled descent of an elevated car.

3. An hydraulic elevator system as claimed in claim 2 including a low-voltage power-energizable directional solenoid valve located in the hydraulic fluid circuit intermediate said line-lock valve and said hydraulic pump, said directional valve being energizable to a first position to allow a flow of hydraulic fluid under pressure to said hydraulic ram for elevation of said car, and energizable to a second position to allow, when said line-lock valve is energized, return of hydraulic fluid from said ram for descent of said car.

4. An hydraulic elevator system as claimed in claim 3 wherein said low-voltage control circuit means responsive to an emergency failure of said main voltage supply includes relay means to simultaneously energize said line-lock valve to an open position and said directional valve to said second position when a switch means in said low-voltage control circuit is actuated to descend said car.

5. An hydraulic elevator system as claimed in claim 4 wherein said backup power supply includes an electric storage battery connected to a main voltage-powered battery charger.

6. A hydraulic elevator system comprising:

an upright hollow column with an elongate aperture extending lengthwise thereof;

a carriage assembly slidably mounted within said column and elevatable by a single-action hydraulic ram mounted within said column;

an elevator car cantilevered from said carriage;

a main powered hydraulic pump for operating said ram to elevate said car;

a low-voltage control circuit to control operation of the hydraulic circuit for selective elevation via said ram and a gravity-aided descent of said elevator car;

said low-voltage control circuit including a low-voltage safety power supply and low-voltage-powered solenoid valves to permit controlled descent of said elevator car in the event of a main power failure and further including low-voltage-powered solenoid-actuated access gate latches to permit selective access to said elevator car;

passenger operable switches operable from within said car and from external call stations for selectively lowering the car upon main failure when it otherwise would be restrained in an elevated position; and said low-voltage control circuit including means responsive to a failure in said main power supply for placing said low-voltage safety power supply in a circuit means with said passenger operable switches, said low-voltage-powered solenoid valves and said solenoid-actuated access gate latches, which circuit means permits selective access to said car by passengers at external hall locations after said power failure for enabling said car to be lowered in response to passenger-initiated control at said hall locations and from within said car.

7. An hydraulic elevator system as claimed in claim 6 wherein said solenoid-actuated gate latches are isolated to lock an access gate at each call station when said elevator car is in motion or located between call stations, said gate latches when isolated being operable to close a control circuit for selective ascent or descent of said elevator car.

8. An hydraulic elevator system as claimed in claim 7 wherein the main power control circuit for said hydraulic pump includes timer means to operate said pump for a predetermined period after said elevator car reaches an elevated call station.

9. An hydraulic elevator system as claimed in claim 6 wherein said low-voltage-powered solenoid valves comprise a line-lock valve operable as a nonreturn valve and a direction-controlling valve, said line-lock valve and said direction-controlling valve being energizable by a descent control switch located in said elevator car or at a call station whereby controlled descent of said elevator car is achieved by controlled bleeding of hydraulic fluid within the hydraulic circuit from said hydraulic ram.

* * * * *